US010674880B2

(12) United States Patent
Onodera et al.

(10) Patent No.: US 10,674,880 B2
(45) Date of Patent: Jun. 9, 2020

(54) TOILET DEVICE

(71) Applicant: TOTO LTD., Kitakyushu-shi, Fukuoka (JP)

(72) Inventors: Naoyuki Onodera, Kitakyushu (JP); Hiroki Hata, Kitakyushu (JP); Yosuke Konomi, Kitakyushu (JP); Yoshikazu Aratsu, Kitakyushu (JP); Yusuke Tone, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/884,555

(22) Filed: Jan. 31, 2018

(65) Prior Publication Data

US 2018/0220858 A1 Aug. 9, 2018

(30) Foreign Application Priority Data

Feb. 3, 2017 (JP) ..... 2017-018467

(51) Int. Cl.
*A47K 13/10* (2006.01)
*A47K 13/12* (2006.01)
*A47K 13/24* (2006.01)

(52) U.S. Cl.
CPC ..... *A47K 13/10* (2013.01); *A47K 13/12* (2013.01); *A47K 13/24* (2013.01)

(58) Field of Classification Search
CPC ..... A47K 13/12; A47K 13/10
USPC ..... 4/246.1, 236, 241, 240, 248
See application file for complete search history.

(56) References Cited

U.S. PATENT DOCUMENTS 631,462 A * 8/1899 Hanington ..... E05F 1/1215 16/298
1,041,181 A * 10/1912 Sharp ..... A47K 13/00 4/237
3,825,958 A * 7/1974 Higginson ..... A47K 13/10 4/240
7,636,956 B1 * 12/2009 Doucet ..... A47K 13/10 4/246.1
2008/0271231 A1 * 11/2008 Stauber ..... A47K 13/10 4/246.1
2009/0106885 A1 * 4/2009 Sagre ..... A47K 13/10 4/246.1

(Continued)

FOREIGN PATENT DOCUMENTS

JP H04-259424 A 9/1992
JP 05269053 A * 10/1993

(Continued)

*Primary Examiner* — Erin Deery
(74) *Attorney, Agent, or Firm* — Pearne & Gordon LLP

(57) ABSTRACT

A toilet device is provided and includes a toilet seat, a main part, and an electric opening/closing mechanism; the toilet seat includes a toilet seat main body, and a hinge part provided at a rear center of the toilet seat main body; the toilet seat is rotatable by being pivotally supported by the main part at two sides of the hinge part; the electric opening/closing mechanism performs an electric opening/closing of the toilet seat and is provided in the main part; the electric opening/closing mechanism includes a motor and a transmission mechanism; the motor is disposed to have a rotation axis offset from a rotation axis of the hinge part; and the transmission mechanism connects the motor and one end of the hinge part and transfers a drive force of the motor to the hinge part.

9 Claims, 8 Drawing Sheets

(56) References Cited

U.S. PATENT DOCUMENTS

2011/0145985 A1* 6/2011 Lin ..... A47K 13/10
4/246.1

FOREIGN PATENT DOCUMENTS

| | | | | | |
|---|---|---|---|---|---|
| JP | 06113980 | A | * | 4/1994 | |
| JP | 2003-102646 | A | | 4/2003 | |
| JP | 2004-176369 | A | | 6/2004 | |
| JP | 2004-223049 | A | | 8/2004 | |
| JP | 2016-077396 | A | | 5/2016 | |
| JP | 2016098610 | A | * | 5/2016 | ..... E03D 9/08 |

* cited by examiner

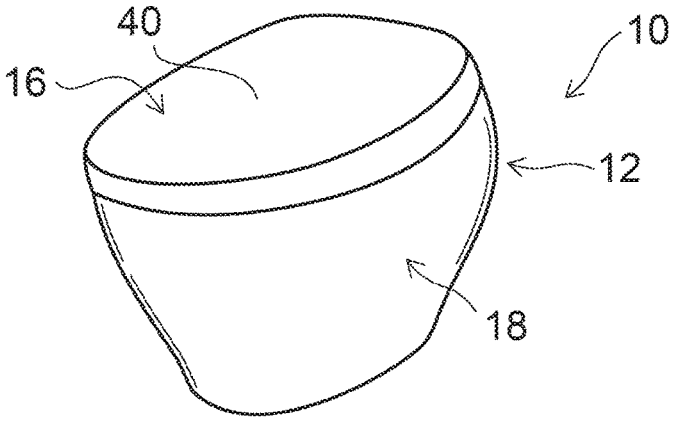
FIG. 1A
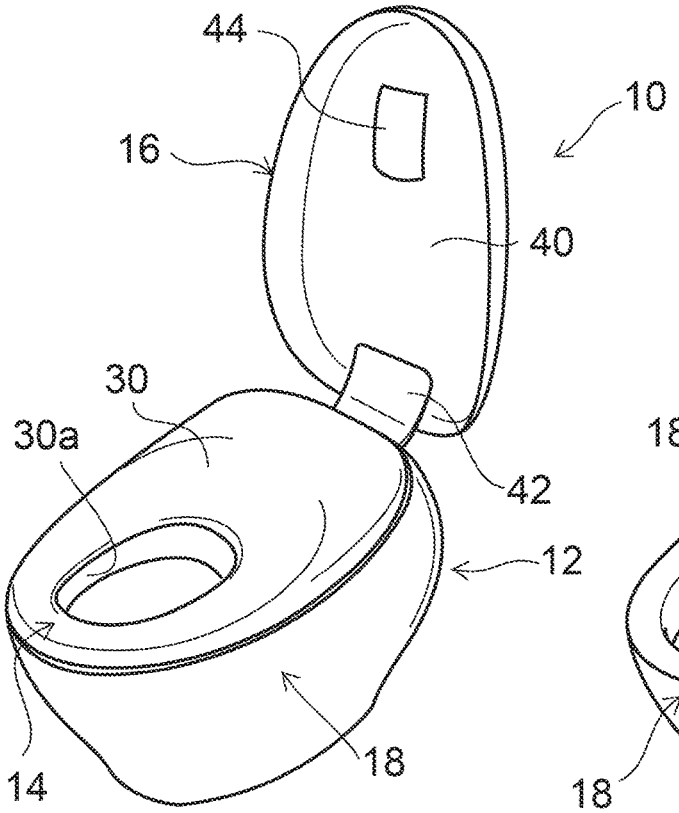
FIG. 1B
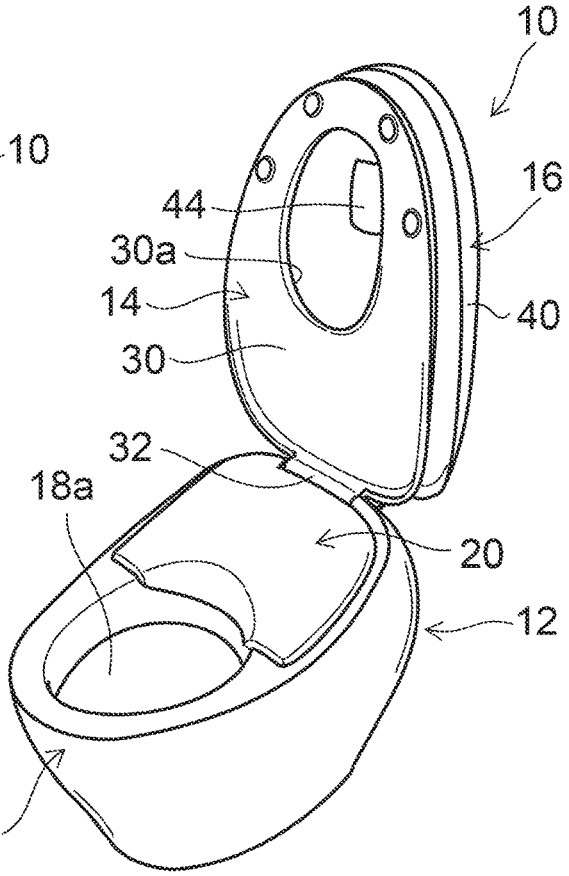
FIG. 1C
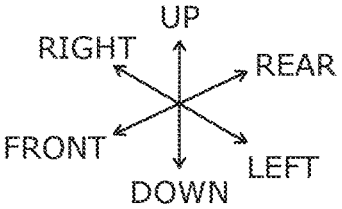

TOILET DEVICE

CROSS-REFERENCE TO RELATED APPLICATIONS

This application is based upon and claims the benefit of priority from Japanese Patent Application No. 2017-018467, filed on Feb. 3, 2017; the entire contents of which are incorporated herein by reference.

FIELD

Embodiments described herein relate generally to a toilet device.

BACKGROUND

A toilet device is known that includes an electric opening/closing mechanism of a toilet seat or a toilet lid, and in which the toilet seat or the toilet lid can be opened and closed automatically (e.g., JP-A 2002-065512 (Kokai)). Also, it is desirable to improve the designability including the toilet seat/toilet lid of the toilet device. However, in the toilet device including the electric opening/closing mechanism, compared to a toilet device not including the electric opening/closing mechanism, the mounting space, etc., of the electric opening/closing mechanism must be provided; and the design easily becomes constrained.

Therefore, it is desirable to increase the degrees of freedom of the design including the toilet seat/toilet lid of the toilet device even in the case where the electric opening/closing mechanism is included.

SUMMARY

According to an embodiment of the invention, a toilet device is provided and includes a toilet seat, a main part, and an electric opening/closing mechanism; the toilet seat includes a toilet seat main body, and a hinge part provided at a rear center of the toilet seat main body; the toilet seat is rotatable by being pivotally supported by the main part at two sides of the hinge part; the electric opening/closing mechanism performs an electric opening/closing of the toilet seat and is provided in the main part; the electric opening/closing mechanism includes a motor and a transmission mechanism; the motor is disposed to have a rotation axis offset from a rotation axis of the hinge part; and the transmission mechanism connects the motor and one end of the hinge part and transfers a drive force of the motor to the hinge part.

BRIEF DESCRIPTION OF THE DRAWINGS

FIG. 1A to FIG. 1C are perspective views illustrating a toilet device according to an embodiment;

DETAILED DESCRIPTION

Figure 2:
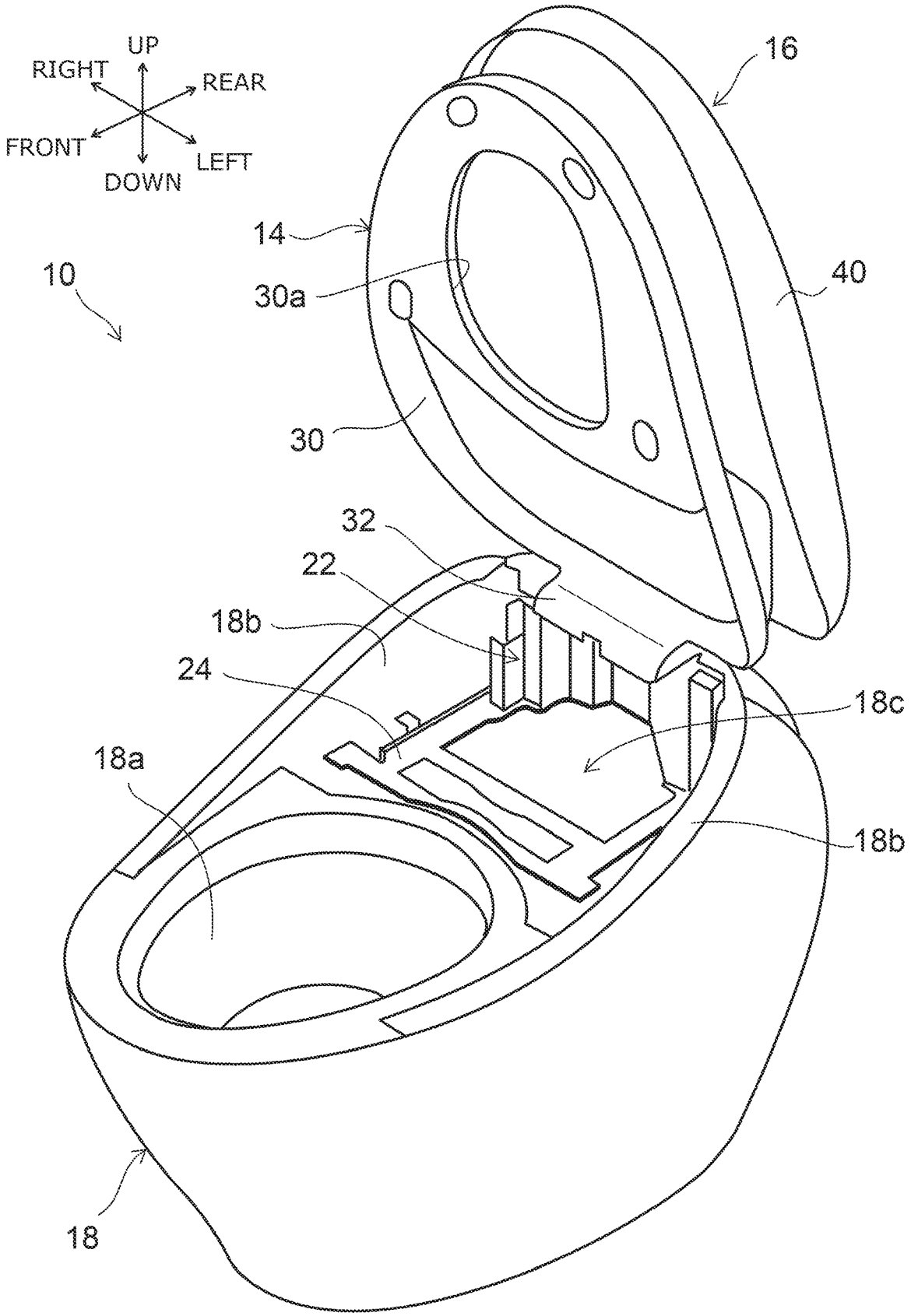
FIG. 2 is a perspective view illustrating a part of the toilet device according to the embodiment.

A first invention is a toilet device including a toilet seat, a main part, and an electric opening/closing mechanism; the toilet seat includes a toilet seat main body and a hinge part; the hinge part is provided at a rear center of the toilet seat main body; the toilet seat is rotatable by being pivotally supported by the main part at two sides of the hinge part; the electric opening/closing mechanism performs an electric opening/closing of the toilet seat and is provided in the main part; the electric opening/closing mechanism includes a motor and a transmission mechanism; the motor is disposed to have a rotation axis offset from a rotation axis of the hinge part; and the transmission mechanism connects the motor and one end of the hinge part and transfers a drive force of the motor to the hinge part.

According to the toilet device, high design degrees of freedom of the toilet seat and the main part can be obtained even in the case where the electric opening/closing mechanism of the toilet seat is included. For example, in a configuration in which two hinge parts are provided in the rear part of the toilet seat and the toilet seat is rotatable by being pivotally supported with a part of the main part interposed between the two hinge parts, the width of the toilet seat rear part must be wide. Conversely, in the configuration in which the hinge part is provided at the rear center of the toilet seat main body and the toilet seat is rotatable by being pivotally supported by the main part at the two sides of the hinge part, the width of the rear part of the toilet seat main body also can be narrow. Accordingly, the design degrees of freedom of the toilet seat can be increased. Also, in a configuration in which the rotation axis of the motor is disposed to be coaxial with the rotation axis of the hinge part, a space that has the length of the motor, etc., must be provided at the side of the hinge part. Therefore, for example, the width of the toilet seat rear part and/or the main part must be wide. Conversely, in the configuration in which the rotation axis of the motor is offset from the rotation axis of the hinge part, and the motor and the hinge part are connected via the transmission mechanism, the length at the side of the hinge part can be shortened compared to the case of being disposed to be coaxial. For example, the electric opening/closing mechanism can be mounted even in a design in which the width of the toilet seat rear part and/or the main part is narrow.

A second invention is a toilet device of the first invention in which the rotation axis of the motor is offset from the rotation axis of the hinge part in the height direction.

According to the toilet device, the space in the height direction can be utilized effectively; and an undesirable increase of the width and/or the length in the frontward/rearward direction of the toilet seat and the main part can be suppressed.

A third invention is the toilet device of the first or second invention, and further includes an assist unit that is provided inside the hinge part and urges the toilet seat in the open direction.

According to the toilet device, by providing the assist unit inside the hinge part, a highly reliable electric opening/closing can be realized while suppressing a larger size of the toilet seat and/or the main part.

A fourth invention is the toilet device of the third invention in which the assist unit includes a case part, an output shaft, an elastic body, a lid part, and a holding member; the case part is provided inside the hinge part; the output shaft is received inside the case part, protrudes outward from one end of the case part and another end of the hinge part, and is pivotally supported by the main part; the elastic body is received inside the case part and urges the toilet seat in the open direction by applying an elastic force to the output shaft; the lid part is mounted to another end of the case part and suppresses a detachment from the case part of the output shaft and the elastic body; the holding member holds the lid part to the case part; the lid part is held to the case part by only one of the holding members; and the holding member is disposed on the toilet seat main body side.

According to the toilet device, the undesirable detachment of the lid part from the case part due to the opening and closing of the toilet seat, etc., can be suppressed by the holding member. Also, by disposing the holding member on the toilet seat main body side, the undesirable increase of the diameter of the hinge part, etc., can be suppressed even in the case where the holding member is provided. For example, the design degrees of freedom of the toilet seat and the main part can be increased further.

A fifth invention is a toilet device of the first invention in which the transmission mechanism includes a shaft part and a gear; the shaft part rotates in conjunction with the motor; the gear has an insertion through-hole for inserting the shaft part; the shaft part includes an engaging part; the gear includes an engaged part engaging in a rotation direction with the engaging part of the shaft part inserted into the insertion through-hole; the gear rotates with the shaft part due to the engagement between the engaging part and the engaged part; a gap is provided between the shaft part and the insertion through-hole; and the gap is for tolerating a positional shift in a direction orthogonal to the rotation axis of the shaft part while allowing the engaging part and the engaged part to engage.

According to the toilet device, the rotation of the motor can be transferred appropriately to the gear; and the occurrence of abnormal sounds, transmission defects of the drive force, etc., due to the positional shift between the shaft part and the insertion through-hole can be suppressed.

A sixth invention is the toilet device of the first invention in which the motor is disposed within the width of the hinge part.

According to the toilet device, the width of the electric opening/closing mechanism can be short; and the design degrees of freedom can be increased further.

A seventh invention is a toilet device including a toilet lid, a main part, and an electric opening/closing mechanism; the toilet lid includes a toilet lid main body and a hinge part; the hinge part is provided at a rear center of the toilet lid main body; the toilet lid is rotatable by being pivotally supported by the main part at two sides of the hinge part; the electric opening/closing mechanism is provided in the main part and performs an electric opening/closing of the toilet lid; the electric opening/closing mechanism includes a motor and a transmission mechanism; the motor is disposed to have a rotation axis offset from a rotation axis of the hinge part; and the transmission mechanism connects the motor and one end of the hinge part and transfers a drive force of the motor to the hinge part.

According to the toilet device, high design degrees of freedom of the toilet lid and the main part can be obtained even in the case where the electric opening/closing mechanism of the toilet lid is included. For example, in a configuration in which two hinge parts are provided in the rear part of the toilet lid and the toilet lid is rotatable by being pivotally supported with a part of the main part interposed between the two hinge parts, the width of the toilet lid rear part must be wide. Conversely, in the configuration in which the hinge part is provided at the rear center of the toilet lid main body and the toilet lid is rotatable by being pivotally supported by the main part at the two sides of the hinge part, the width of the rear part of the toilet lid main body also can be narrow. Accordingly, the design degrees of freedom of the toilet lid can be increased. Also, in a configuration in which the rotation axis of the motor is disposed to be coaxial with the rotation axis of the hinge part, a space that has the length of the motor, etc., must be provided at the side of the hinge part. Therefore, for example, the width of the toilet lid rear part and/or the main part must be wide. Conversely, in the configuration in which the rotation axis of the motor is offset from the rotation axis of the hinge part, and the motor and the hinge part are connected via the transmission mechanism, the length at the side of the hinge part can be shortened compared to the case of being disposed to be coaxial. For example, the electric opening/closing mechanism can be mounted even in a design in which the width of the toilet lid rear part and/or the main part is narrow.

Embodiments will now be described with reference to the drawings. Similar components in the drawings are marked with the same reference numerals; and a detailed description is omitted as appropriate.

FIG. 1A to FIG. 1C are perspective views illustrating a toilet device according to an embodiment.

As illustrated in FIGS. 1A to 1C, the toilet device 10 includes a main part 12, a toilet seat 14, and a toilet lid 16.

The main part 12 includes, for example, a western-style sit-down toilet (called simply the "toilet" for convenience of description hereinbelow) 18 and a functional part 20. The functional part 20 is mounted to the toilet 18. For example, the functional part 20 has various functions such as a private part washing function of washing a human private part (e.g., the "bottom," etc.) of a user, a drying function of drying the human private part, a toilet seat heating function of warming the seat surface of the toilet seat 14, etc. In other words, the functional part 20 is a sanitary washing device or a toilet seat warming device. The functional part 20 is mounted as one body with the toilet 18. The functional part 20 may be mounted detachably to the toilet 18.

The toilet 18 includes a bowl 18*a*. The bowl 18*a* is a concave configuration that is concave downward. The toilet 18 receives, in the bowl 18*a*, excrement such as urine, feces, etc., of the user. The functional part 20 is mounted to a part of the toilet 18 rearward of the bowl 18*a*.

The toilet seat 14 includes a toilet seat main body 30 and a hinge part 32. The hinge part 32 is provided at the rear center of the toilet seat main body 30. The toilet lid 16 includes a toilet lid main body 40 and a hinge part 42. The hinge part 42 is provided at the rear center of the toilet lid main body 40. The main part 12 pivotally supports the toilet seat 14 at two sides of the hinge part 32 so that the toilet seat 14 is rotatable, and pivotally supports the toilet lid 16 at two sides of the hinge part 42 so that the toilet lid 16 is rotatable.

The toilet seat 14 moves between the closed position illustrated in FIG. 1B and the open position illustrated in FIG. 1C by being pivotally supported by the main part 12 via the hinge part 32. The closed position is the position of being placed on the bowl 18*a* of the toilet 18 so that the user can be seated. The open position is the position of being retracted upward from the toilet 18 to expose the upper surface of the toilet 18, etc. In other words, the closed position is the state in which the toilet seat 14 is lowered; and in other words, the open position is the state in which the toilet seat 14 is raised.

The toilet seat main body 30 has an opening 30*a* that exposes at least a part of the bowl 18*a* upward when at the closed position. In the example, the toilet seat 14 is a so-called O-type toilet seat having an opening 30*a* having a through-hole configuration. The toilet seat 14 is not limited to the O-type and may be a U-type. The opening 30*a* may have a notch configuration in which a notch is formed in the front end part of the toilet seat main body 30.

The toilet lid 16 moves between the closed position illustrated in FIG. 1A and the open position illustrated in FIG. 1B and FIG. 1C by being pivotally supported by the main part 12 via the hinge part 42. The closed position is a position that covers the toilet 18 and the toilet seat 14 from above. The open position is a position of being retracted upward from the toilet 18 and the toilet seat 14 to expose the toilet seat 14. In the toilet device 10, the toilet device 10 can be used in the state of being seated on the toilet seat 14 by setting the toilet lid 16 to the open position and setting the toilet seat 14 to the closed position.

Here, in this specification, up when viewed by a user seated on the toilet seat 14 is taken as "up;" and down when viewed by the user seated on the toilet seat 14 is taken as "down." Also, when viewed by the user seated on the toilet seat 14 having the back of the user toward the toilet lid 16 in the open state, front is taken as "front;" rear is taken as "rear;" right is taken as "right;" and left is taken as "left."

The toilet lid 16 further includes a light source unit 44. The light source unit 44 is provided in a surface on the inner side of the toilet lid main body 40 and is disposed at a position opposing the bowl 18*a* of the toilet 18 (the opening 30*a* of the toilet seat 14) in the state in which the toilet lid 16 is closed. A photocatalyst layer is provided on the surface of the bowl 18*a*. The light source unit 44 activates the photocatalyst layer by irradiating ultraviolet toward the photocatalyst layer in the state in which the toilet lid 16 is closed. Thereby, for example, dirt or the like that is adhered to the surface of the bowl 18*a* is decomposed; and the bacteria on the surface of the bowl 18*a* can be reduced. The hydrophilic property of the photocatalyst layer is improved so that the dirt or the like adheres less easily to the surface of the bowl 18*a*.

FIG. 2 is a perspective view illustrating a part of the toilet device according to the embodiment.

FIG. 2 illustrates the state in which the functional part 20 is detached from the toilet device 10.

As illustrated in FIG. 2, the two side parts of the toilet 18 include incline parts 18*b* inclining upward toward the rear. In the state when viewed from the side, the height of the toilet 18 increases gradually toward the rear from the height of the front end part forming the height of the seat surface. The toilet 18 has a space 18*c* having a hollow configuration between the incline parts 18*b* rearward of the bowl 18*a*. The toilet 18 receives at least a part of the functional part 20 inside the space 18*c*. In the example, a part of the functional part 20 protrudes higher than the toilet 18 (referring to FIG. 1C). The toilet 18 may receive the entire functional part 20 inside the space 18*c*.

As illustrated in FIG. 2, the toilet seat 14 and the toilet lid 16 are pivotally supported by the toilet 18. The toilet 18 includes a supporter 22 pivotally supporting the toilet seat 14 and the toilet lid 16 so that the toilet seat 14 and the toilet lid 16 are rotatable. The supporter 22 is mounted inside the space 18*c* of the toilet 18 via a support plate 24. The supporter 22 is disposed rearward of the functional part 20. Accordingly, the rotation axis of the toilet seat 14 and the rotation axis of the toilet lid 16 are disposed rearward of the functional part 20. The configuration of the toilet 18 when viewed from above is a substantially elliptical configuration. The width of the toilet 18 widens gradually from the front end part toward the central part and narrows gradually from the central part toward the rear end part. The toilet 18 pivotally supports, at the rear end part that has a narrower width than the central part, the toilet seat 14 and the toilet lid 16 so that the toilet seat 14 and the toilet lid 16 are rotatable.

In the closed position, the toilet seat 14 covers above the rim of the bowl 18*a* of the toilet 18 and covers above the entire functional part 20 (referring to FIG. 1B and FIG. 1C). Thus, the toilet seat 14 covers above the entire functional part 20; and the functional part 20 is not viewed by the user standing frontward of the toilet device 10 in the state in which the toilet seat 14 is at the closed position. Thereby, the design quality of the toilet device 10 can be improved. Also, at the closed position, the toilet seat 14 covers the sides of parts protruding higher than the toilet 18 (referring to FIG. 1B). Thereby, even when viewed from the side, the viewing of the functional part 20 can be suppressed; and the design quality of the toilet device 10 can be improved further.

The hinge part 42 of the toilet lid 16 is positioned rearward of the hinge part 32 of the toilet seat 14. For example, the rotation axis of the toilet lid 16 is positioned below and at the rear of the rotation axis of the toilet seat 14. Thereby, at the closed position, the toilet lid 16 covers the entire toilet seat 14 from above and covers the side of the toilet seat 14. The configuration of the toilet lid 16 corresponds to the configuration of the upper end of the toilet 18 and suppresses a gap opening between the toilet 18 at the closed position. Thereby, in the state in which the toilet lid 16 is closed as well, the design quality of the toilet device 10 can be improved.

Figure 3:
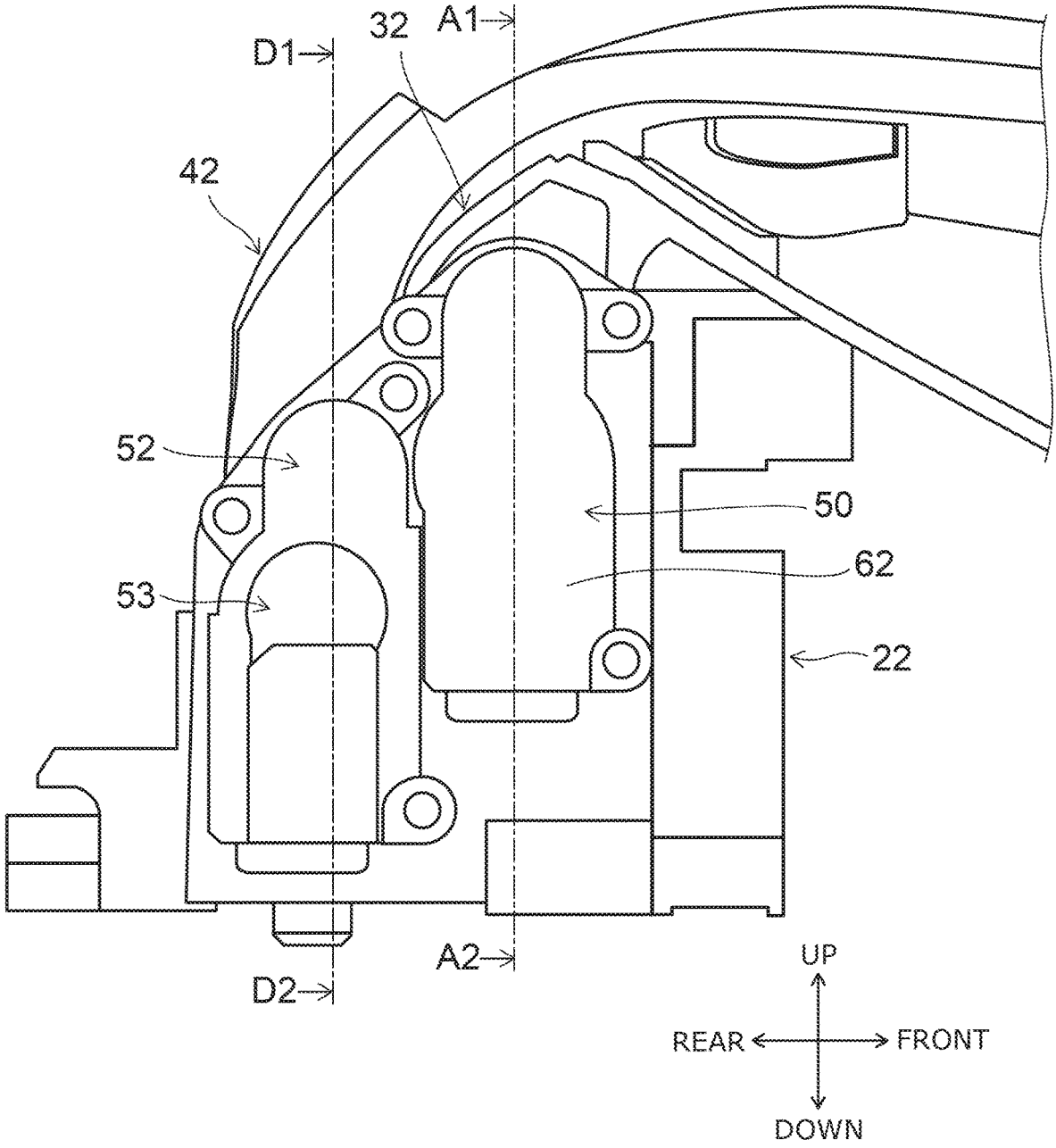
FIG. 3 is a side view illustrating a part of the toilet device according to the embodiment.

FIG. 3 is a side view illustrating a part of the toilet device according to the embodiment.

As illustrated in FIG. 3, the toilet device 10 further includes electric opening/closing mechanisms 50 and 52. The electric opening/closing mechanisms 50 and 52 are provided in the main part 12. For example, the electric opening/closing mechanisms 50 and 52 are mounted to the supporter 22 inside the space 18*c* of the toilet 18. The electric opening/closing mechanism 50 performs the electric opening/closing of the toilet seat 14. The electric opening/closing mechanism 52 performs the electric opening/closing of the toilet lid 16. For example, the electric opening/closing mechanisms 50 and 52 perform the electric opening/closing of the toilet seat 14 and the toilet lid 16 according to the detection result of the user by a human body detection sensor or an instruction from an operation part such as a remote control, etc.

The electric opening/closing mechanism 52 includes an interlock mechanism 53. The interlock mechanism 53 mechanically breaks the current path to the light source unit 44 according to the movement from the closed position to the open position of the toilet lid 16. In other words, the interlock mechanism 53 allows the irradiation of the ultraviolet from the light source unit 44 only when the toilet lid 16 is in the vicinity of the closed position. Thereby, undesirable irradiation of the ultraviolet on the user, etc., can be suppressed appropriately.

Figure 4:
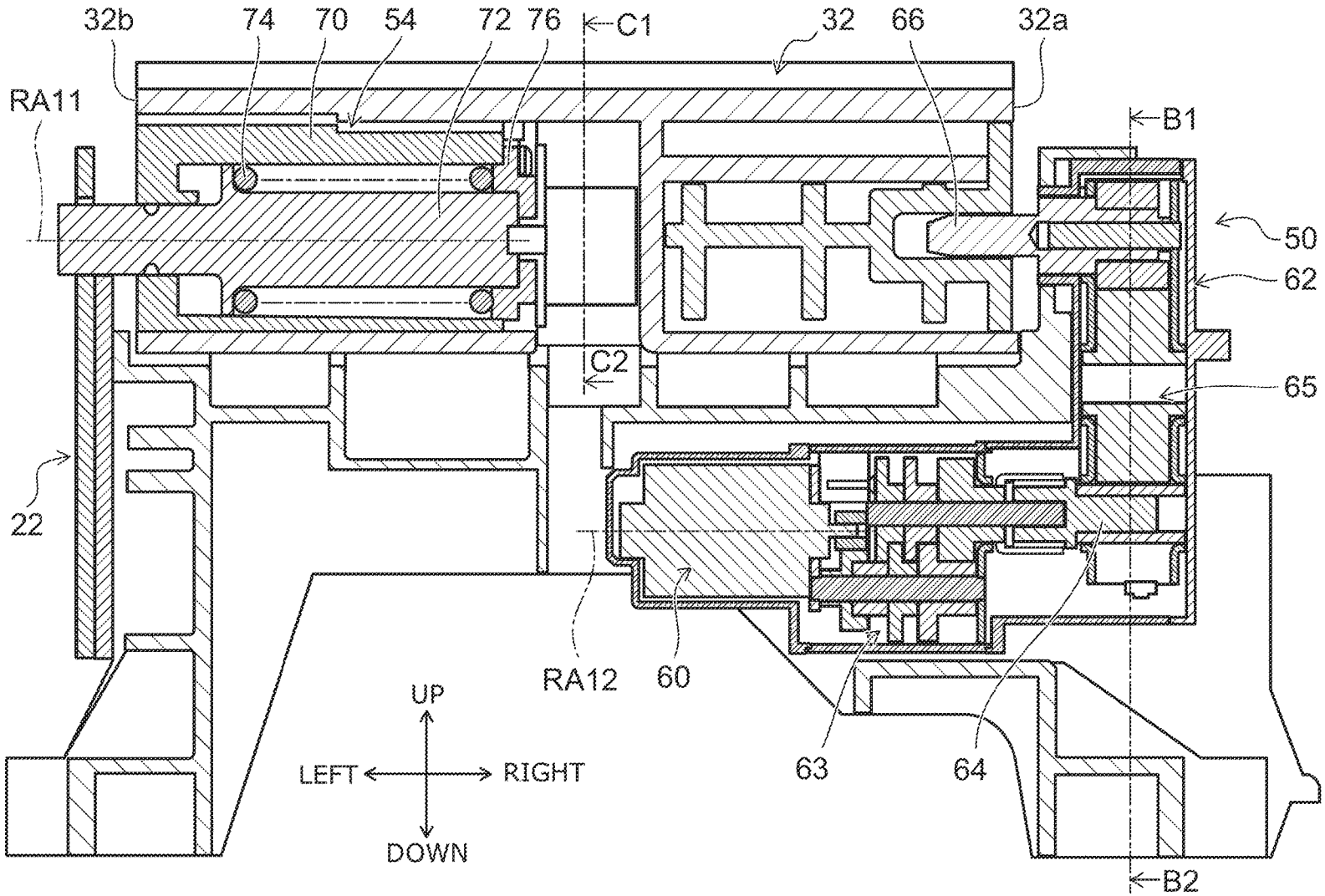
FIG. 4 is a cross-sectional view illustrating the electric opening/closing mechanism of the toilet seat.

FIG. 4 is a cross-sectional view illustrating the electric opening/closing mechanism of the toilet seat.

FIG. 4 corresponds to a line A1-A2 cross section of FIG. 3.

As illustrated in FIG. 4, the electric opening/closing mechanism 50 of the toilet seat 14 includes a motor 60 and a transmission mechanism 62. The motor 60 is disposed to have a rotation axis RA12 offset from a rotation axis RA11 of the hinge part 32 of the toilet seat 14. In other words, the rotation axis RA12 of the motor 60 is not coaxial with the rotation axis RA11 of the hinge part 32. The transmission mechanism 62 connects the motor 60 and one end 32*a* of the hinge part 32 and transfers the drive force of the motor 60 to the hinge part 32.

The rotation axis RA12 of the motor 60 is offset from the rotation axis RA11 of the hinge part 32 in the height direction. For example, the rotation axis RA12 of the motor 60 is offset downward from the rotation axis RA11 of the hinge part 32.

The motor 60 is disposed within the width of the hinge part 32. Thereby, the length (the lateral width) in the left/right direction of the electric opening/closing mechanism 50 can be shortened. At least a part of the motor 60 overlaps at least a part of the hinge part 32 in the vertical direction. In other words, the motor 60 is disposed perpendicularly downward from the hinge part 32. Thereby, the length in the frontward/rearward direction of the electric opening/closing mechanism 50 also can be shortened.

The rotation axis RA12 of the motor 60 is substantially parallel to the rotation axis RA11 of the hinge part 32. Thereby, the motor 60 can be disposed more efficiently. For example, the length in the frontward/rearward direction of the electric opening/closing mechanism 50 can be shorter; and the length in the vertical direction of the electric opening/closing mechanism 50 can be shorter compared to the case where the rotation axis RA12 of the motor 60 is orthogonal to the rotation axis RA11 of the hinge part 32 (the case where the rotation axis RA12 extends in the vertical direction), etc.

The direction of the offset of the rotation axis RA12 of the motor 60 is not limited to the downward direction and may be the upward direction or the frontward/rearward direction. The position of the motor 60 is not limited to that recited above and may be, for example, any appropriately-arrangeable position inside the space 18*c* of the toilet 18.

The transmission mechanism 62 includes, for example, a gear train 63, a shaft part 64, a gear train 65, and an output shaft 66. The gear train 63 includes multiple gears; and the drive force of the motor 60 is transferred to the shaft part 64 by each of the gears. The shaft part 64 rotates in conjunction with the motor 60 due to the drive force transferred from the gear train 63. The gear train 65 includes multiple gears and transfers the drive force to the output shaft 66 according to the rotation of the shaft part 64 by each of the gears. The output shaft 66 is connected to the gear train 65 and connected to the one end 32*a* of the hinge part 32. The output shaft 66 rotates according to the drive force transferred from the gear train 65 and transfers the rotational drive force to the hinge part 32. The rotation axis of the output shaft 66 is, for example, coaxial with the rotation axis RA11 of the hinge part 32. Thereby, the toilet seat 14 can be electrically opened and closed according to the rotation of the output shaft 66.

Figure 5A:
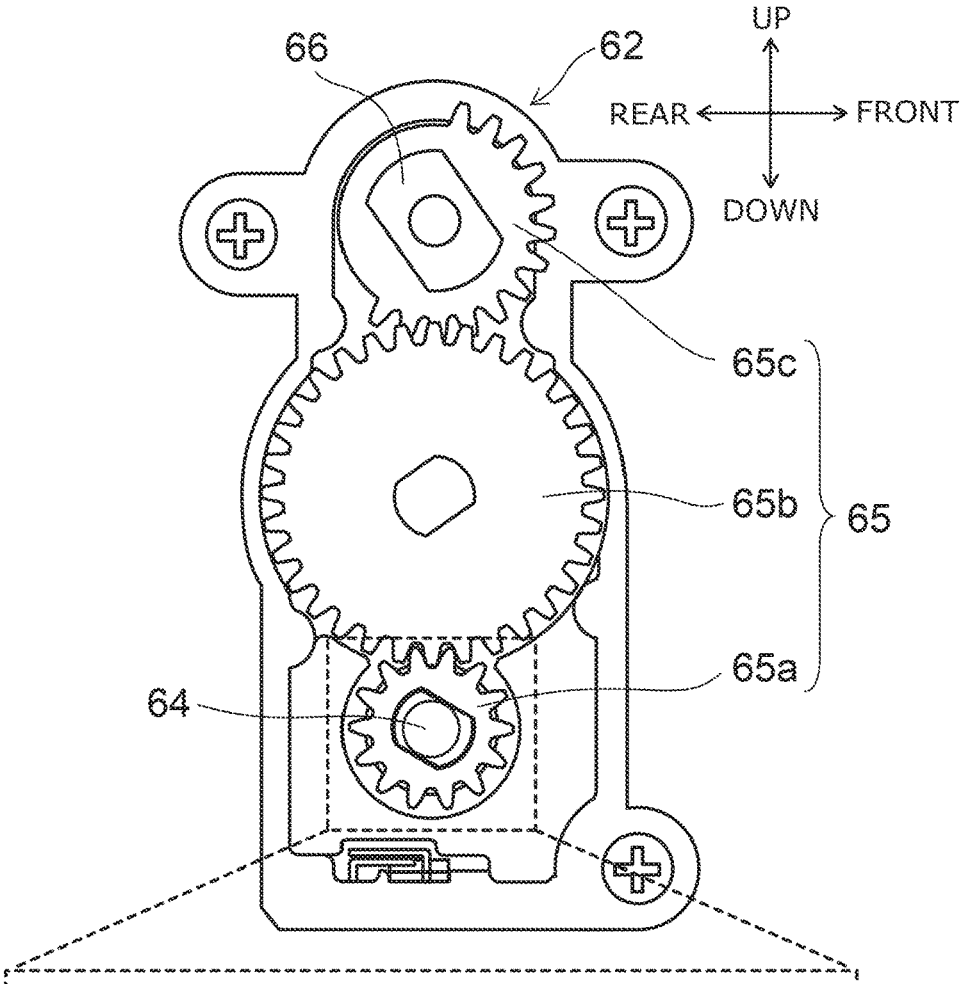
FIG. 5A and FIG. 5B are cross-sectional views illustrating a part of the transmission mechanism.
Figure 5B:
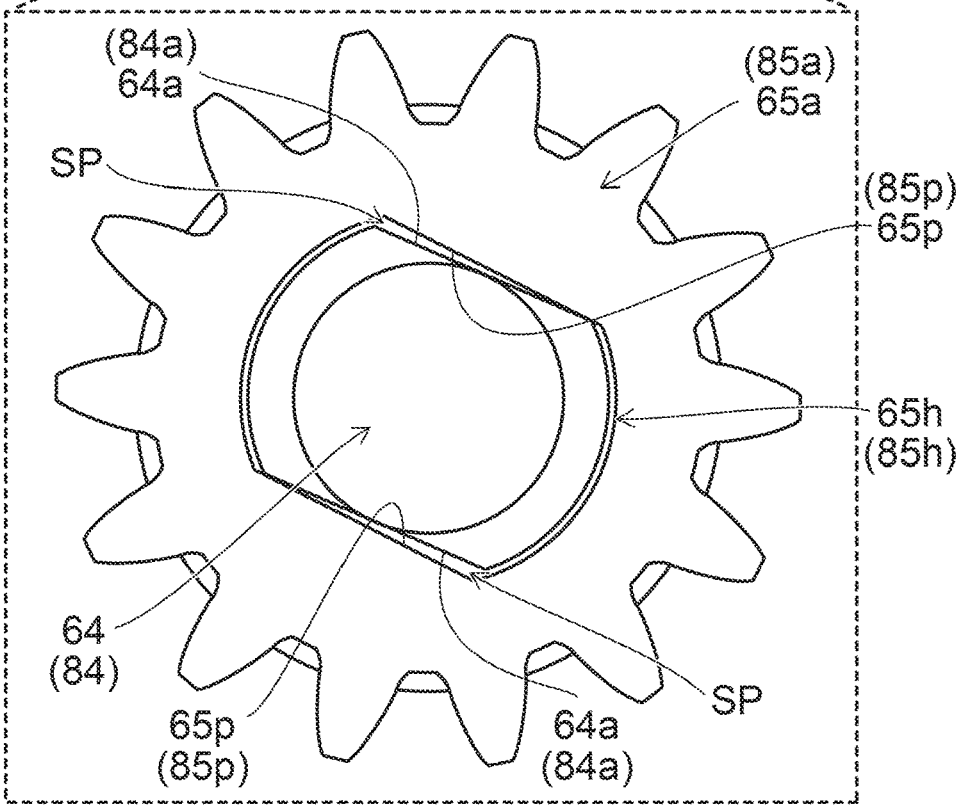

FIG. 5A and FIG. 5B are cross-sectional views illustrating a part of the transmission mechanism.

FIG. 5A and FIG. 5B illustrate a line B1-B2 cross section of FIG. 4.

As illustrated in FIG. 5A, the gear train 65 of the transmission mechanism 62 includes, for example, the three gears of gears 65*a* to 65*c* and transfers the rotational drive force of the shaft part 64 to the output shaft 66 by each of the gears 65*a* to 65*c*. The number of gears included in the gear train 65 is not limited to three and may be one, two, four, or more.

FIG. 5B illustrates an enlarged part of the shaft part 64 and the gear 65*a* of FIG. 5A. As illustrated in FIG. 5B, the gear 65*a* has an insertion through-hole 65*h* for inserting the tip of the shaft part 64. The insertion through-hole 65*h* may have a through-hole configuration or may be a hole not going completely through.

The shaft part 64 includes an engaging part 64*a* at the tip part inserted into the insertion through-hole 65*h*. In the example, the engaging part 64*a* has a configuration in which a part of the circumferential surface of the tip part having a round rod configuration is ground to be flat. In the example, the engaging part 64*a* is a so-called D-cut. The shaft part 64 also includes the pair of engaging parts 64*a* disposed at opposing positions. The number of the engaging parts 64*a* may be one, three, or more.

The gear 65*a* includes an engaged part 65*p* that engages the engaging part 64*a* of the shaft part 64 inserted into the insertion through-hole 65*h* in the rotation direction. The gear 65*a* includes a pair of engaged parts 65*p* corresponding respectively to the pair of engaging parts 64*a*. For example, the number of the engaged parts 65*p* corresponds to the number of the engaging parts 64*a*. The gear 65*a* rotates with the shaft part 64 due to the engagement between the engaging parts 64*a* and the engaged parts 65*p*. In the example, the configuration of the engaged part 65*p* is a planar configuration corresponding to the engaging part 64*a* having a planar configuration. The configuration of the engaging part 64*a* and the configuration of the engaged part 65*p* may be any configuration engageable in the rotation direction.

The inner diameter of the part of the insertion through-hole 65*h* having the circular arc-like configuration is slightly larger than the outer diameter of the part of the shaft part 64 having the circular arc-like configuration. The spacing between the engaged parts 65*p* is slightly larger than the spacing between the engaging parts 64*a*. Thereby, a gap SP for tolerating a positional shift in a direction orthogonal to the rotation axis of the shaft part 64 is provided between the shaft part 64 and the insertion through-hole 65*h* while allowing the engaging parts 64*a* and the engaged parts 65*p* to engage. For example, the gap SP is play for absorbing the dimension error between the gear train 63 on the motor 60 side and the gear train 65 on the output shaft 66 side, etc.

Returning now to FIG. 4, the toilet device 10 further includes an assist unit 54. The assist unit 54 is provided inside the hinge part 32 and urges the toilet seat 14 in the open direction. Thereby, the assist unit 54 assists the operation of the electric opening/closing mechanism 50 of moving the toilet seat 14 from the closed position to the open position. Thus, by providing the assist unit 54, the necessary torque of the motor 60 can be small; and downsizing of the motor 60 can be realized.

The assist unit 54 includes, for example, a case part 70, an output shaft 72, an elastic body 74, and a lid part 76. The case part 70 is provided inside the hinge part 32. The output shaft 72 is received inside the case part 70, protrudes outward from one end of the case part 70 and another end 32*b* of the hinge part 32, and is pivotally supported by the supporter 22 (the main part 12). The case part 70 receives the output shaft 72 so that the output shaft 72 is rotatable around an axis. On the other hand, the supporter 22 pivotally supports the output shaft 72 so that the output shaft 72 does not rotate. The case part 70 rotates with the output shaft 72 as an axis in the opening and closing of the toilet seat 14.

Thus, in the toilet seat 14, the one end 32*a* of the hinge part 32 is pivotally supported by the supporter 22 via the output shaft 66 of the electric opening/closing mechanism 50; and the other end 32*b* of the hinge part 32 is pivotally supported by the supporter 22 via the output shaft 72 of the assist unit 54. Thereby, the toilet seat 14 rotates between the closed position and the open position.

The elastic body 74 is received inside the case part 70 and urges the toilet seat 14 in the open direction by applying an elastic force to the output shaft 72. The elastic body 74 is, for example, a torsion spring. One end of the elastic body 74 is connected to the case part 70. The other end of the elastic body 74 is connected to the output shaft 72. Thereby, the elastic force can be applied to the output shaft 72. For example, compared to the case where the assist unit 54 is not provided, the toilet seat 14 can be moved from the closed position to the open position by a small force.

The lid part 76 is mounted to the other end of the case part 70 and suppresses the detachment from the case part 70 of the output shaft 72 and the elastic body 74.

Figure 6:
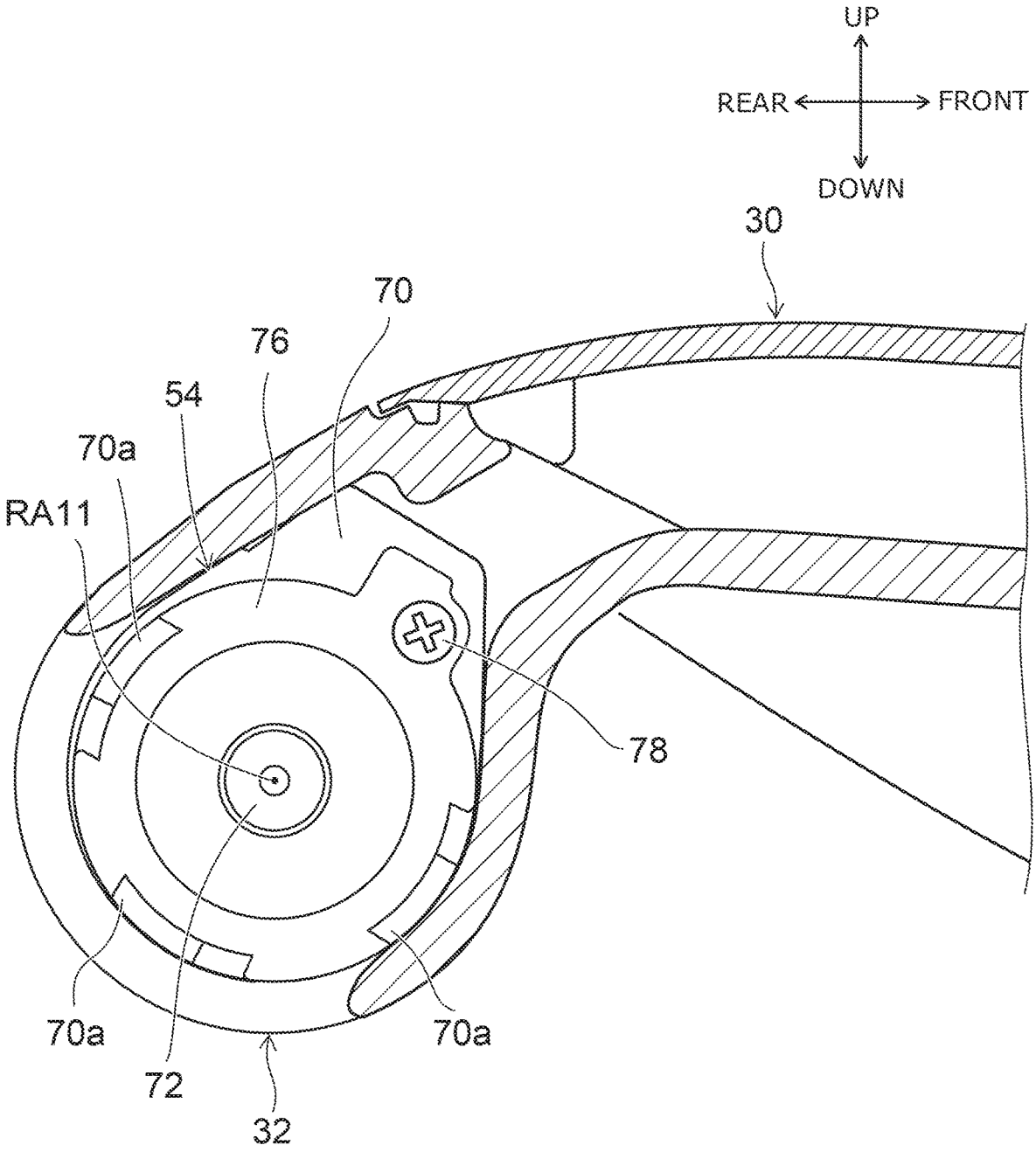
FIG. 6 is a cross-sectional view illustrating the assist unit and the hinge part of the toilet seat.

FIG. 6 is a cross-sectional view illustrating the assist unit and the hinge part of the toilet seat.

FIG. 6 illustrates a line C1-C2 cross section of FIG. 4.

As illustrated in FIG. 6, the assist unit 54 further includes a holding member 78. The holding member 78 holds the lid part 76 to the case part 70. The holding member 78 is, for example, a screw. The lid part 76 is held to the case part 70 by only one holding member 78. The holding member 78 is not limited to a screw and may be any member that can hold the lid part 76.

The case part 70 includes an engagement tab 70*a*. The lid part 76 is in a state of being mounted to the case part 70 by being rotated around the axis and by having a part engaging the engagement tab 70*a*. Due to the engagement with the engagement tab 70*a*, the movement of the lid part 76 is regulated in a direction aligned with the rotation axis of the output shaft 72 (a direction orthogonal to the page surface). In other words, the movement in a direction away from the case part 70 is regulated. The holding member 78 regulates the rotation of the lid part 76 mounted to the case part 70 by the engagement with the engagement tab 70*a*. In other words, the holding member 78 regulates the movement of the lid part 76 in a direction away from the engagement tab 70*a*. Thereby, the lid part 76 can be held appropriately to the case part 70 by even one holding member 78. In the example, the holding member 78 includes three engagement tabs 70*a*. The number of the engagement tabs 70*a* is not limited to three and may be one, two, four, or more.

As illustrated in FIG. 6, the holding member 78 is disposed on the toilet seat main body 30 side. For example, the interior space of the hinge part 32 includes a part having a cylindrical configuration including the rotation axis RA11 (the center of rotation), and a part extending toward the toilet seat main body 30 side from the part having the cylindrical configuration. The holding member 78 is disposed in the part of the interior space of the hinge part 32 extending toward the toilet seat main body 30 side.

Figure 7:
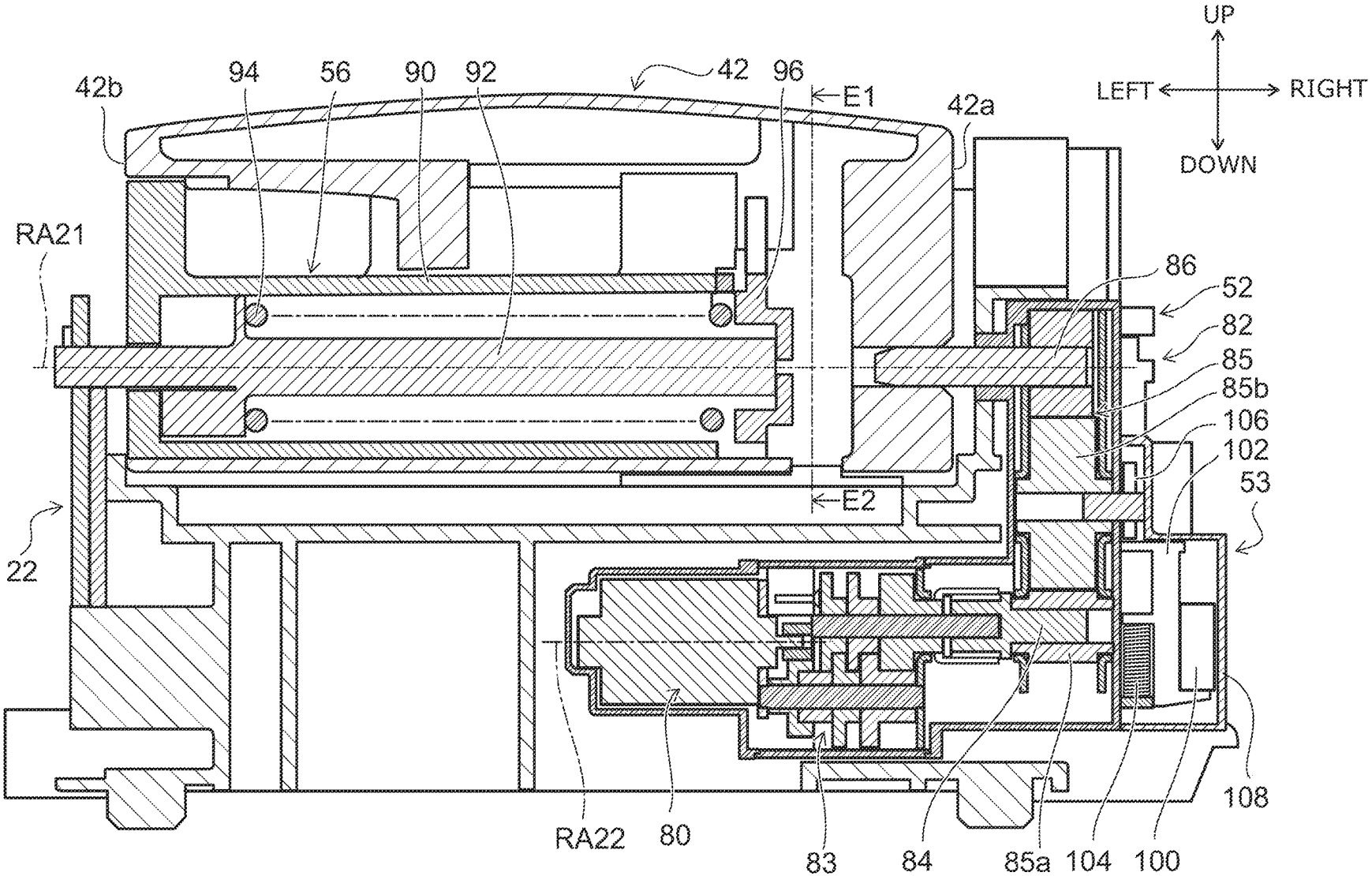
FIG. 7 is a cross-sectional view illustrating the electric opening/closing mechanism of the toilet lid.

FIG. 7 is a cross-sectional view illustrating the electric opening/closing mechanism of the toilet lid.

FIG. 7 corresponds to a line D1-D2 cross section of FIG. 3.

As illustrated in FIG. 7, the electric opening/closing mechanism 52 of the toilet lid 16 includes a motor 80 and a transmission mechanism 82. The configuration of the electric opening/closing mechanism 52 of the toilet lid 16 is substantially the same as the configuration of the electric opening/closing mechanism 50 of the toilet seat 14; and a detailed description is therefore omitted. Only the gist of the electric opening/closing mechanism 52 will now be described.

The motor 80 is disposed to have a rotation axis RA22 offset from a rotation axis RA21 of the hinge part 42 of the toilet lid 16. The rotation axis RA22 of the motor 80 is offset from the rotation axis RA21 of the hinge part 42 in the height direction. The motor 80 is disposed within the width of the hinge part 42. The transmission mechanism 82 connects the motor 80 and one end 42*a* of the hinge part 42 and transfers the drive force of the motor 80 to the hinge part 42.

The transmission mechanism 82 includes, for example, a gear train 83, a shaft part 84, a gear train 85, and an output shaft 86. The gear train 85 includes a gear 85*a*. The shaft part 84 is similar to the shaft part 64. The gear 85*a* is similar to the gear 65*a*. The gear 85*a* has an insertion through-hole 85*h* for inserting the tip of the shaft part 84. The shaft part 84 includes an engaging part 84*a* at the tip part inserted into the insertion through-hole 85*h*. The gear 85*a* includes an engaged part 85*p* that engages, in the rotation direction, the engaging part 84*a* of the shaft part 84 inserted into the insertion through-hole 85*h*. Between the shaft part 84 and the insertion through-hole 85*h*, the gap SP is provided for tolerating a positional shift in a direction orthogonal to the rotation axis of the shaft part 84 while allowing the engaging parts 84*a* and the engaged parts 85*p* to engage (referring to FIG. 5B).

The toilet device 10 further includes an assist unit 56. The assist unit 56 is provided inside the hinge part 42 and urges the toilet lid 16 in the open direction. The assist unit 56 includes, for example, a case part 90, an output shaft 92, an elastic body 94, and a lid part 96.

Figure 8:
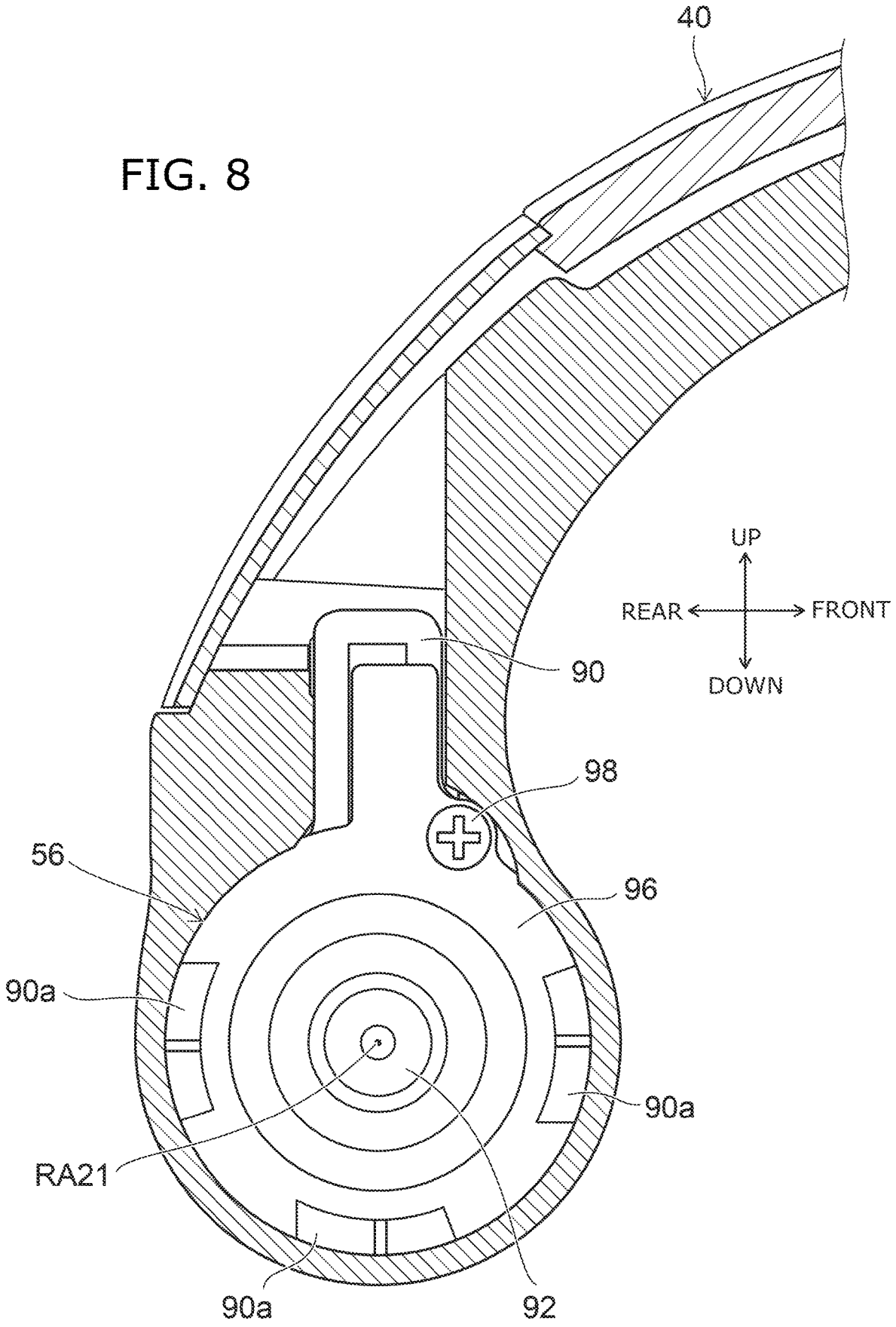
FIG. 8 is a cross-sectional view illustrating the assist unit and the hinge part of the toilet lid.

FIG. 8 is a cross-sectional view illustrating the assist unit and the hinge part of the toilet lid.

FIG. 8 illustrates a line E1-E2 cross section of FIG. 7.

As illustrated in FIG. 8, the assist unit 56 further includes a holding member 98. The case part 90 includes an engagement tab 90*a*. The lid part 96 is in a state of being mounted to the case part 90 by having a part rotated around the axis and caused to engage with the engagement tab 90*a*. The holding member 98 is disposed on the toilet lid main body 40 side.

Returning now to FIG. 7, the interlock mechanism 53 includes, for example, a switch 100, a slider 102, a spring 104, a rotating cam 106, and a case 108. The switch 100 is a mechanical switch that mechanically switches a contact point ON and OFF.

The contact point of the switch 100 is connected to the light source unit 44. By switching the switch 100 ON, a flow of current in the light source unit 44 is possible; and by switching the switch 100 OFF, the current path to the light source unit 44 is broken. In other words, the switch 100 is configured as part of the current path of the light source unit 44.

For example, the slider 102 is supported by the case 108 to be slidable in the vertical direction; and the slider 102 moves between a position of contacting the contact point of the switch 100 to switch the switch 100 ON, and a position separated from the contact point of the switch 100 to switch the switch 100 OFF. For example, the slider 102 switches the switch 100 ON when positioned up, and switches the switch 100 OFF when positioned down.

For example, the spring 104 is provided between the slider 102 and the case 108 and urges the slider 102 upward. In other words, the spring 104 urges the slider 102 toward the side of the switch 100 being ON.

For example, the rotating cam 106 is connected to be coaxial with a gear 85*b* of the gear train 85 of the electric opening/closing mechanism 52 (corresponding to a gear 65*b* of FIG. 5A) and rotates following the gear 85*b*. The rotating cam 106 retreats from the slider 102 when the toilet lid 16 is within a prescribed range from the closed position. Thereby, when the toilet lid 16 is within the prescribed range from the closed position, the slider 102 moves up according to the urging force of the spring 104 and switches the switch 100 ON. Accordingly, when the toilet lid 16 is within the prescribed range from the closed position, the irradiation of the ultraviolet from the light source unit 44 is possible. The "prescribed range" is, for example, a range of the degree of opening of the toilet lid 16 of about 0° to 50° when the closed position is taken to be 0°.

When the toilet lid 16 is more open than the prescribed range, the rotating cam 106 contacts the upper end of the slider 102 and presses the slider 102 downward against the urging force of the spring 104. Thereby, when the toilet lid 16 is more open than the prescribed range, the slider 102 separates from the contact point of the switch 100; and the switch 100 is switched OFF. Accordingly, when the toilet lid 16 is more open than the prescribed range, the current path to the light source unit 44 is mechanically broken; and the ultraviolet can no longer be irradiated from the light source unit 44.

Thus, by providing the interlock mechanism 53 as one body with the electric opening/closing mechanism 52, for example, the electrical connection with the interlock mechanism 53 can be easy. It also may be considered to provide the interlock mechanism 53 on the assist unit 56 side. However, in the case where the interlock mechanism 53 is provided on the side of the assist unit 56 disposed inside the hinge part 42, it is undesirably difficult to provide a wire path to the interior of the hinge part 42 which is the rotation part. For example, extra space for the wires becomes necessary; members for holding the wires must be increased; and there is a possibility that the device may undesirably become larger.

Accordingly, as recited above, the interlock mechanism 53 is provided as one body with the electric opening/closing mechanism 52. Thereby, even in the case where the interlock mechanism 53 is provided, the wiring to the interlock mechanism 53 is easy; and a larger size of the device, etc., also can be suppressed. The configuration of the interlock mechanism 53 is not limited to that recited above; and any configuration may be used in which the current path to the light source unit 44 is mechanically breakable.

As described above, according to the toilet device 10 according to the embodiment, high design degrees of freedom of the toilet seat 14, the toilet lid 16, and the main part 12 can be obtained even in the case where the electric opening/closing mechanism 50 of the toilet seat 14 and the electric opening/closing mechanism 52 of the toilet lid 16 are included. For example, the electric opening/closing mechanisms 50 and 52 can be mounted even in a design in which the width is narrow in the left/right direction for the rear part of the main part 12 and the rear parts of the toilet seat 14 and the toilet lid 16.

In the toilet device 10, the rotation axes of the motors 60 and 80 are offset from the rotation axes of the hinge parts 32 and 42 in the height direction. Thereby, the space in the height direction can be utilized effectively; and an undesirable increase of the width and the length in the frontward/rearward direction of the toilet seat 14, the toilet lid 16, and the main part 12 can be suppressed. For example, an undesirable encroachment of the space of the functional part 20 by the electric opening/closing mechanisms 50 and 52 can be suppressed.

By providing the assist units 54 and 56 inside the hinge parts 32 and 42 in the toilet device 10, a highly reliable electric opening/closing can be realized while suppressing a larger size of the toilet seat 14, the toilet lid 16, and the main part 12.

In the toilet device 10, the undesirable detachment from the case parts 70 and 90 of the lid parts 76 and 96 in the opening and closing of the toilet seat 14 or the toilet lid 16, etc., can be suppressed by the holding members 78 and 98. By disposing the holding members 78 and 98 on the toilet seat main body 30 side or the toilet lid main body 40 side, undesirably large diameters of the hinge parts 32 and 42, etc., can be suppressed even in the case where the holding members 78 and 98 are provided. For example, the design degrees of freedom of the toilet seat 14, the toilet lid 16, and the main part 12 can be increased further.

In the toilet device 10, between the shaft parts 64 and 84 and the insertion through-holes **65*h* and 85*h*, the gap SP is provided for tolerating positional shifts in directions orthogonal to the rotation axes of the shaft parts 64 and 84 while allowing the engaging parts 64*a* and 84*a* and the engaged parts 65*p* and 85*p* to engage. Thereby, the rotations of the motors 60 and 80 can be transferred appropriately to the gears 65*a* and 85*a*; and the occurrence of abnormal sounds, transmission defects of the drive force, etc., due to the positional shift between the shaft parts 64 and 84 and the insertion through-holes 65*h* and 85*h*** can be suppressed.

In the toilet device 10, the motors 60 and 80 are disposed within the widths of the hinge parts 32 and 42. Thereby, the widths in the left/right direction of the electric opening/closing mechanisms 50 and 52 can be short; and the design degrees of freedom can be increased further.

The toilet device 10 that includes the electric opening/closing mechanism 50 of the toilet seat 14 and the electric opening/closing mechanism 52 of the toilet lid 16 is shown in the embodiment recited above. The toilet device 10 may include only one of the electric opening/closing mechanism 50 or 52. In the case where the toilet device 10 includes only the electric opening/closing mechanism 50 of the toilet seat 14, the toilet lid 16 is provided as necessary and is omissible. In the embodiment recited above, the toilet seat 14 and the toilet lid 16 are pivotally supported by the toilet 18 to be rotatable. This is not limited thereto; for example, the functional part 20 may pivotally support the toilet seat 14 and the toilet lid 16 so that the toilet seat 14 and the toilet lid 16 are rotatable. The electric opening/closing mechanisms 50 and 52 may be provided in the functional part 20. The toilet device 10 in which the toilet 18 and the functional part 20 are formed as one body is shown in the embodiment recited above. The toilet device 10 may be, for example, a so-called seat-type sanitary washing device that is mounted detachably on the toilet 18, etc.

Embodiments of the invention are described above. However, the invention is not limited to these descriptions. Appropriate design modifications by one skilled in the art relating to the embodiments described above also are within the scope of the invention to the extent that the spirit of the invention is included. For example, the configurations, dimensions, material properties, arrangements, mounting methods, etc., of the components included in the toilet device 10 are not limited to those illustrated and can be modified appropriately.

The components included in the embodiments described above can be combined within the extent of technical feasibility; and such combinations are within the scope of the invention to the extent that the spirit of the invention is included.

What is claimed is:

1. A toilet device, comprising:

a toilet seat including a toilet seat main body and a hinge part, the hinge part being provided at a rear center of the toilet seat main body, the hinge part having a rotation axis extending to a right and left direction;

a main part, the toilet seat being rotatable by being pivotally supported by the main part at two sides of the right and left direction of the hinge part; and an electric opening/closing mechanism performing an electric opening/closing of the toilet seat and being provided in the main part, the electric opening/closing mechanism including a motor disposed to have a rotation axis offset from the rotation axis of the hinge part, and a transmission mechanism connecting the motor and one end of the right and left direction of the hinge part and transferring a drive force of the motor to the hinge part, the main part including a toilet, the toilet having a bowl, pair of sidewall portions, and a space, the pair of sidewall portions being provided on two side parts of the toilet and provided rearward of the bowl, a height of each of the pair of sidewall portions being higher than a height of a front end part of the toilet, the space being provided rearward of the bowl and provided between the pair of sidewall portions, the space having a hollow configuration and being opened upward, the motor being disposed under the hinge part and being provided in the space and provided between the pair of sidewall portions, and at least a part of the motor overlapping with at least a part of the hinge part when viewed in a vertical direction.

2. The device according to claim 1, wherein the rotation axis of the motor is offset from the rotation axis of the hinge part in a height direction.

3. The device according to claim 1, further comprising an assist unit being provided inside the hinge part, the assist unit including an elastic body and urging the toilet seat in an open direction by an elastic force of the elastic body.

4. The device according to claim 2, further comprising an assist unit being provided inside the hinge part, the assist unit including an elastic body and urging the toilet seat in an open direction by an elastic force of the elastic body.

5. The device according to claim 3, wherein the assist unit includes:

a case part provided inside the hinge part;

an output shaft received inside the case part, the output shaft protruding outward from one end of the right and left direction of the case part and from another end of the right and left direction of the hinge part and being pivotally supported by the main part;

a lid part mounted to another end of the right and left direction of the case part, the lid part suppressing a detachment from the case part of the output shaft and the elastic body; and a screw holding the lid part to the case part, the elastic body received inside the case part, the elastic body urges the toilet seat in the open direction by applying the elastic force to the output shaft, the lid part being held to the case part by only the screw, the screw being disposed between the rotation axis of the hinge part and the toilet seat main body.

6. The device according to claim 4, wherein the assist unit includes:

a case part provided inside the hinge part;

an output shaft received inside the case part, the output shaft protruding outward from one end of the right and left direction of the case part and from another end of the right and left direction of the hinge part and being pivotally supported by the main part;

a lid part mounted to another end of the right and left direction of the case part, the lid part suppressing a detachment from the case part of the output shaft and the elastic body; and a screw holding the lid part to the case part, the elastic body received inside the case part, the elastic body urges the toilet seat in the open direction by applying the elastic force to the output shaft, the lid part being held to the case part by only the screw, the screw being disposed between the rotation axis of the hinge part and the toilet seat main body.

7. The device according to claim 1, wherein the transmission mechanism includes a shaft part and a gear, the shaft part rotating in conjunction with the motor, the gear having an insertion through-hole for inserting the shaft part, the shaft part including an engaging part, the gear including an engaged part engaging in a rotation direction with the engaging part of the shaft part inserted into the insertion through-hole, the gear rotating with the shaft part due to the engagement between the engaging part and the engaged part, and a gap is provided between the shaft part and the insertion through-hole, the gap being for tolerating a positional shift in a direction orthogonal to the rotation axis of the shaft part while allowing the engaging part and the engaged part to engage.

8. The device according to claim 1, wherein the motor is disposed within a width of the hinge part.

9. A toilet device, comprising:

a toilet lid including a toilet lid main body and a hinge part, the hinge part being provided at a rear center of the toilet lid main body, the hinge part having a rotation axis extending to a right and left direction;

a main part, the toilet lid being rotatable by being pivotally supported by the main part at two sides of the right and left direction of the hinge part; and an electric opening/closing mechanism performing an electric opening/closing of the toilet lid and being provided in the main part, the electric opening/closing mechanism including a motor disposed to have a rotation axis offset from the rotation axis of the hinge part, and a transmission mechanism connecting the motor and one end of the right and left direction of the hinge part and transferring a drive force of the motor to the hinge part, the main part including a toilet, the toilet having a bowl, pair of sidewall portions, and a space, the pair of sidewall portions being provided on two side parts of the toilet and provided rearward of the bowl, a height of each of the pair of sidewall portions being higher than a height of a front end part of the toilet, the space being provided rearward of the bowl and provided between the pair of sidewall portions, the space having a hollow configuration and being opened upward, the motor being disposed under the hinge part and being provided in the space and provided between the pair of sidewall portions, and at least a part of the motor overlapping with at least a part of the hinge part when viewed in a vertical direction.

* * * * *